US007959498B2

(12) United States Patent
Schrottner

(10) Patent No.: US 7,959,498 B2
(45) Date of Patent: Jun. 14, 2011

(54) GRINDING DISK SHIELD

(76) Inventor: Gerhard Schrottner, Krottendorf-Gaisfeld (AT)

( * ) Notice: Subject to any disclaimer, the term of this patent is extended or adjusted under 35 U.S.C. 154(b) by 627 days.

(21) Appl. No.: 11/884,194

(22) PCT Filed: Feb. 3, 2006

(86) PCT No.: PCT/EP2006/000928

§ 371 (c)(1),
(2), (4) Date: May 14, 2008

(87) PCT Pub. No.: WO2006/084630

PCT Pub. Date: Aug. 17, 2006

(65) Prior Publication Data

US 2008/0318502 A1 Dec. 25, 2008

(30) Foreign Application Priority Data

Feb. 9, 2005 (AT) ..... A 210/2005

(51) Int. Cl.
*B24B 55/02* (2006.01)

(52) U.S. Cl. ..... 451/449; 451/450

(58) Field of Classification Search ..... 451/449, 451/450
See application file for complete search history.

(56) References Cited

U.S. PATENT DOCUMENTS

| | | | | |
|---|---|---|---|---|
| 2,612,015 | A * | 9/1952 | Krafft | 451/450 |
| 2,708,332 | A * | 5/1955 | Riddell et al. | 451/450 |
| 3,064,400 | A * | 11/1962 | Johnson | 451/450 |
| 3,543,451 | A * | 12/1970 | Smith | 451/450 |
| 4,570,609 | A * | 2/1986 | Hogue | 125/13.01 |
| 4,739,586 | A * | 4/1988 | Eckardt et al. | 451/251 |
| 5,423,717 | A * | 6/1995 | Boaz | 451/449 |
| 6,186,136 | B1 * | 2/2001 | Osborne | 125/21 |
| 2004/0029510 | A1 | 2/2004 | Yoshimi et al. | |

* cited by examiner

*Primary Examiner* — Maurina Rachuba
(74) *Attorney, Agent, or Firm* — Andrew Wilford

(57) ABSTRACT

The invention relates to an internally cooled grinding disc shielding (16), wherein a cooling liquid (14) outwardly flows thorough a recess embodied in the peripheral surface of a grinding disk, the shielding is provided with a collecting groove (17) for the cooling liquid (14) which surrounds the grinding disc (1) under a sector comprises at least one discharge nozzle (20) which is arranged on the output side and by means of which a jet is directed to a work piece (13) or to a grinding point (16).

9 Claims, 7 Drawing Sheets

6
5
9
10
4
7
2
1
3
3
8
12
11
15
14
13
16

19
12
18
20
8
21
3
6
9
2
1
3
7
24
17

GRINDING DISK SHIELD

CROSS REFERENCE TO RELATED APPLICATIONS

This application is the US national phase of PCT application PCT/EP2006/000928, filed 3 Feb. 2006, published 17 Aug. 2006 as WO 2006/084630, and claiming the priority of Austrian patent application A210/2005 itself filed 9 Feb. 2005, whose entire disclosures are herewith incorporated by reference.

FIELD OF THE INVENTION

The invention relates to grinding disk shield for internally cooled grinding disks, where a cooling liquid is outwardly discharged through openings in the outer grinding surface.

BACKGROUND OF THE INVENTION

For internally cooled grinding disks, the cooling liquid is supplied to internal cavities in the grinding disk, from which point the cooling liquid passes at high pressure through passages to openings in the peripheral grinding surface and is outwardly discharged. The quantities of cooling liquid may be very large for large grinding disks having a diameter of 400 mm, for example. Thus, for example, such a grinding disk operating at 3000 RPM and a cooling liquid pressure of 40 to 60 bar requires approximately 200 liters of liquid per minute. However, the cooling effect of the cooling liquid is needed primarily at the grinding location at which the grinding disk contacts the workpiece to be machined. Thus, a significant quantity of cooling liquid and the associated pumping capacity are wasted. The aim is to increase the cooling power at a lower cost.

A grinding-disk shield is known and also required by regulatory requirements, so that a sector of the grinding disk is covered by a sheet-steel cover in order to prevent injuries when parts of the grinding disk or the workpiece are projected outward. These protective plates capture a portion of the emitted cooling liquid, but do not improve the cooling effect.

SUMMARY OF THE INVENTION

The present invention is characterized in that the shield has a collecting groove for the cooling liquid which surrounds the grinding disk over a sector and which has at least one discharge nozzle on the output side, by means of which a jet may be directed onto the workpiece to be ground, or onto the grinding location.

BRIEF DESCRIPTION OF THE DRAWING

Further advantageous features are contained in the following description, the drawings, and the claims. The invention is explained in greater detail below, with reference to several illustrated embodiments.

SPECIFIC DESCRIPTION

Figure 1:
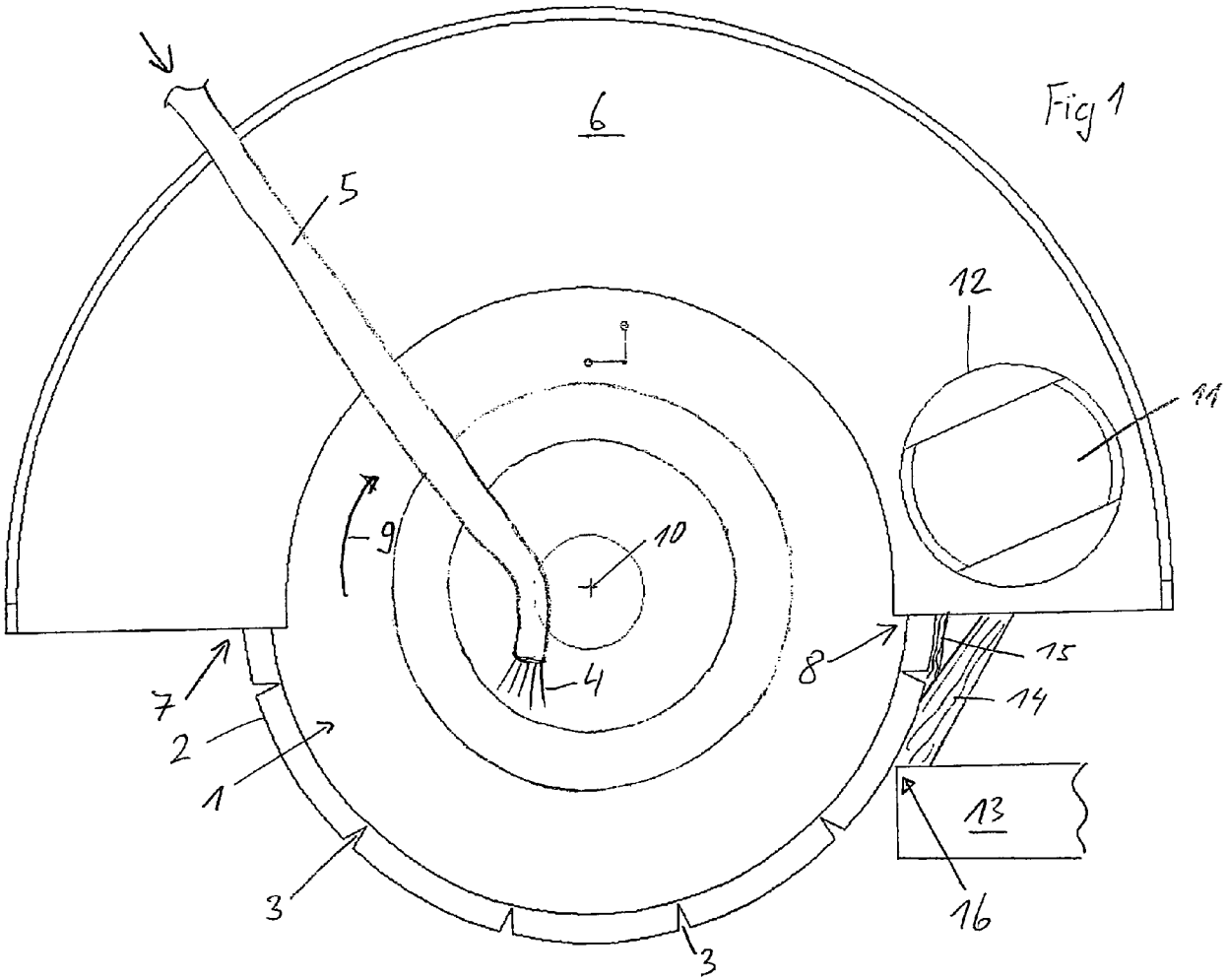
FIG. 1 shows a side view of a grinding-disk system having grinding-disk shield according to the invention.

According to FIG. 1, the system comprises a grinding disk 1 having a grinding surface 2 and discharge openings 3 for the cooling liquid 4. The cooling liquid under is fed under high pressure through a conduit 5 into the interior of the grinding disk 1, and from there, in a manner known per se, passes through a chamber system and passages to the discharge openings 3.

A grinding-disk shield 6 has an inlet 7 and an outlet 8 and extends over a sector of the grinding disk 1. The grinding disk 1 rotates about the axis 10 in a rotational direction 9.

Visible on the output side is the handle 11 of a rotary element 12 that fits in a seat in the grinding-disk shield 6, and that passes through same and is rotatable by means of the handle 11. FIG. 1 also shows the workpiece 13 and two substreams 14 and 15 of the cooling liquid 4. One substream 15 flows along the grinding surface 2 of the grinding disk 1, and the substream 14 is projected in a targeted manner from the grinding-disk shield 6 onto the grinding location 16.

Figure 2:
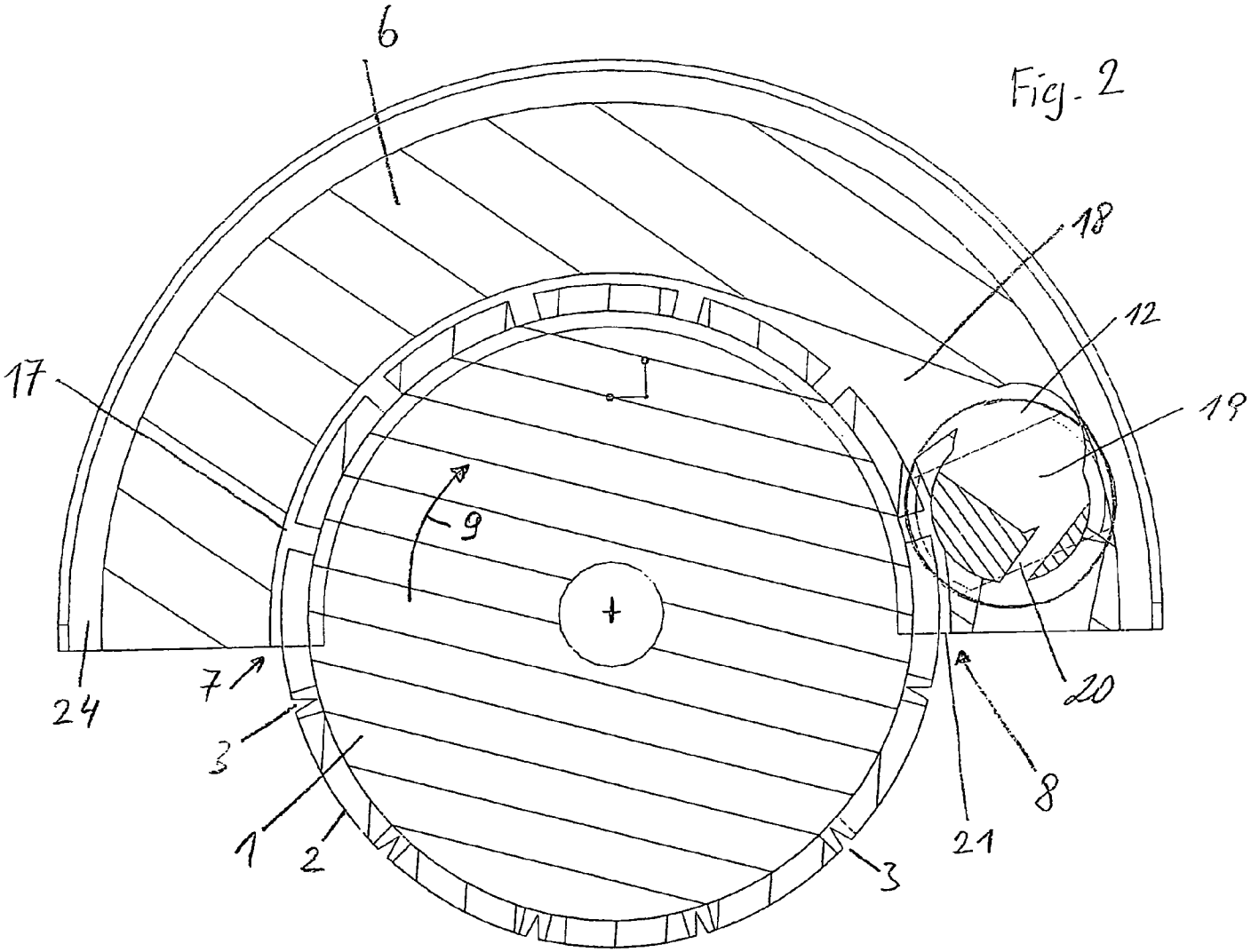
FIG. 2 shows a sectional view of this system.

The sectional illustration according to FIG. 2 shows the internal design of the system. The grinding disk 1 is only schematically illustrated, and the chambers and passages for the distribution and supply of cooling liquid are not shown. In this case it is only important that the cooling liquid conducted inside the grinding disk be supplied to the outlet openings 3 via these chambers and passages, from which point the liquid is discharged in an approximately radial direction.

In the vicinity of the grinding-disk shield 6 the grinding disk 1 forms a collecting groove 17 (FIG. 3) having a relatively small clearance around the grinding disk 1. The collecting groove 17 extends over a portion of the periphery of the grinding disk, parallel to the grinding surface 2, and widens in the direction of the outlet 8. An end 18 widens in a continuous progression from the collecting groove 6. In the vicinity of the widening 18 is located a rotary element 12 together with a collection chamber 19 from which a discharge nozzle 20] extends in the direction of the outlet 8 of the grinding-disk shield 6. FIG. 2 also shows that at the outlet 8 the collecting groove 17 on the rotary body passes along the grinding disk 1, thereby forming an outlet slot 21.

After exiting through the outlet openings 3, the cooling liquid supplied to the grinding disk 1 is collected under high pressure in the sector of the grinding disk 1 covered by the grinding-disk shield 6, and is transported toward the outlet 8. The cooling liquid passes into the widening 18 and into the collection chamber 19. From there, the substream of the cooling liquid shown at 14 in FIG. 1 is compressed by the discharge nozzle 20. The other substream 15 may be entrained along the grinding surface 2 by means of the grinding disk 1 and may be discharged through the outlet slot 21.

Rotation of the rotary element 12 can direct the substream 14 from the discharge nozzle 20 in such a way that the substream 14 strikes the workpiece 13 precisely at the intended location.

Figure 3:
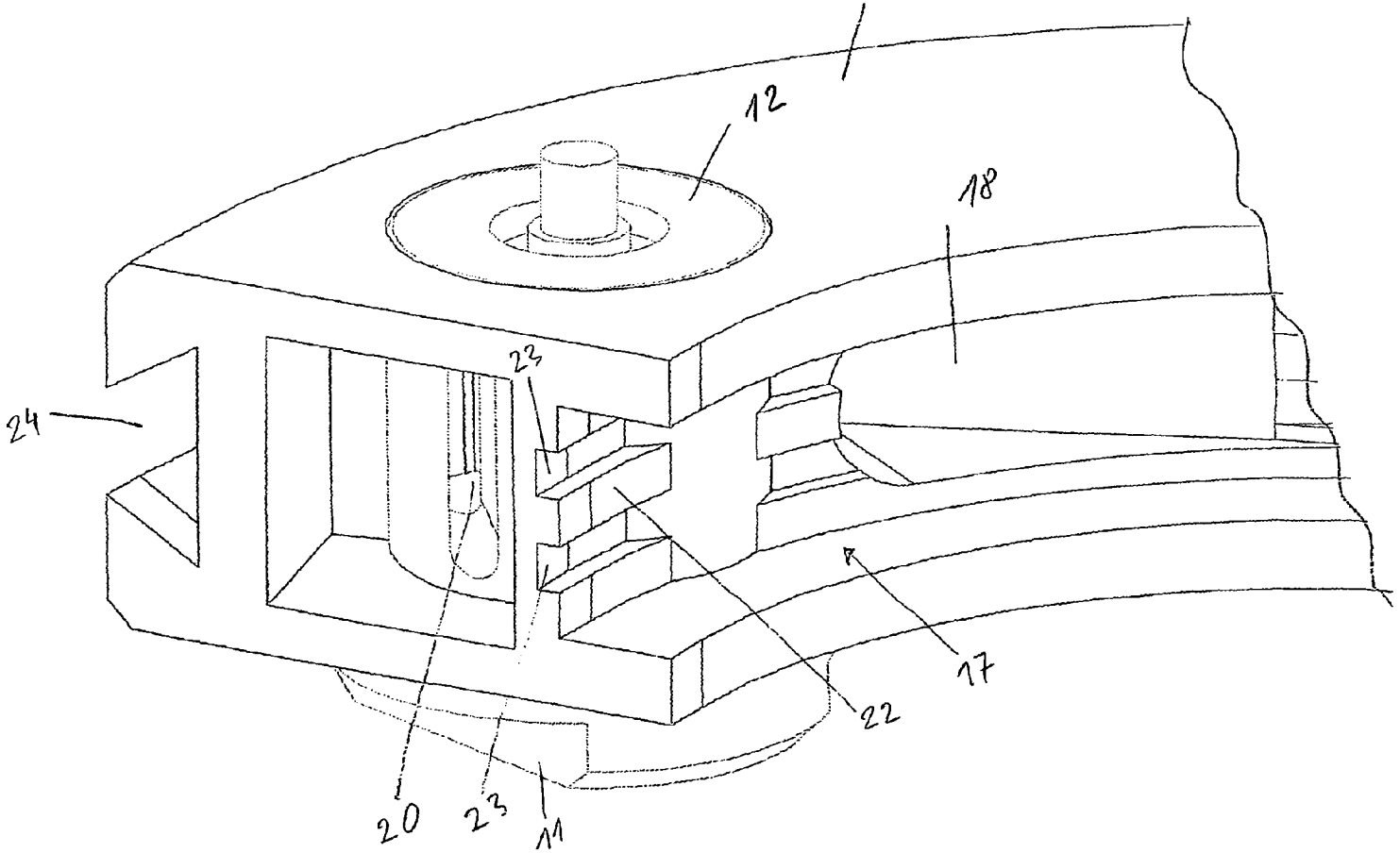
FIG. 3 shows an oblique view of the output-side end of the grinding-disk shield.

FIG. 3 shows the outlet of the grinding-disk shield 1, with the grinding disk omitted. Its inner surface 22 has two parallel grooves 23 which receive the cooling liquid in the collecting groove 17. The discharge nozzle 20 is designed as a continuous slot.

At the outer surface of the grinding-disk shield 6 is located a peripheral undercut groove 24 that via appropriate fastening means is used to mount the grinding-disk shield 6 and adjustably position same.

Figure 4:
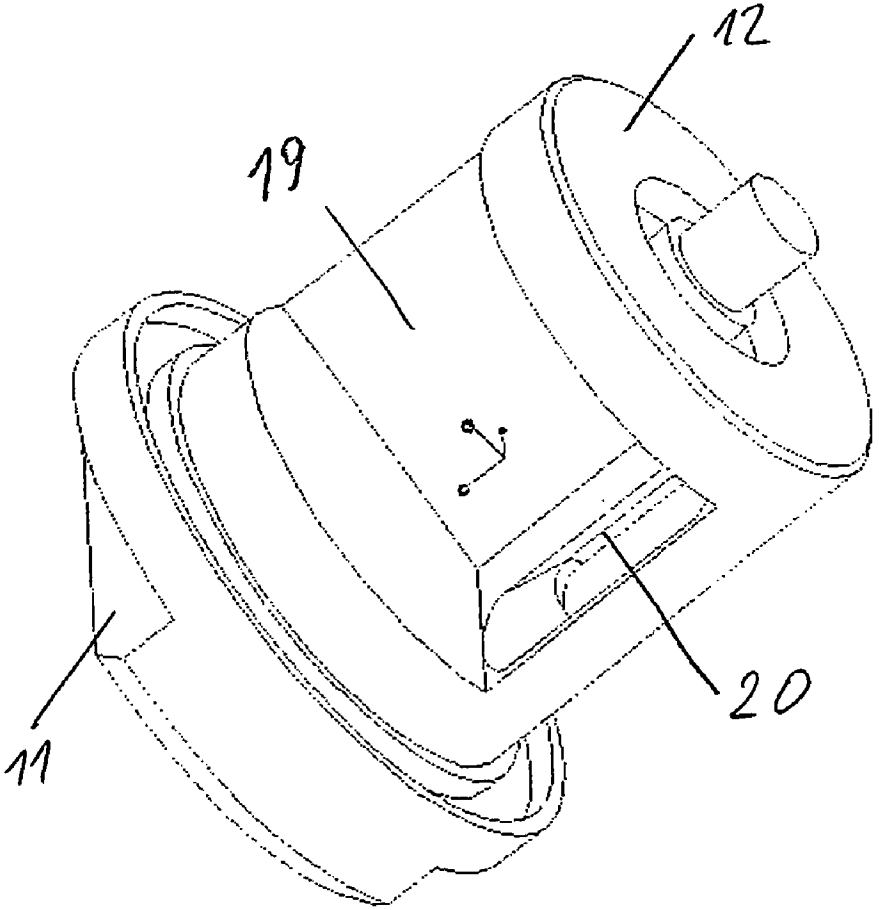
FIGS. 4 through 6 show details of various embodiments.

FIG. 4 shows the rotary element 12 in the design of FIG. 3. View is into the collection chamber 19, from which the discharge nozzle 20 extends.

Figure 5:
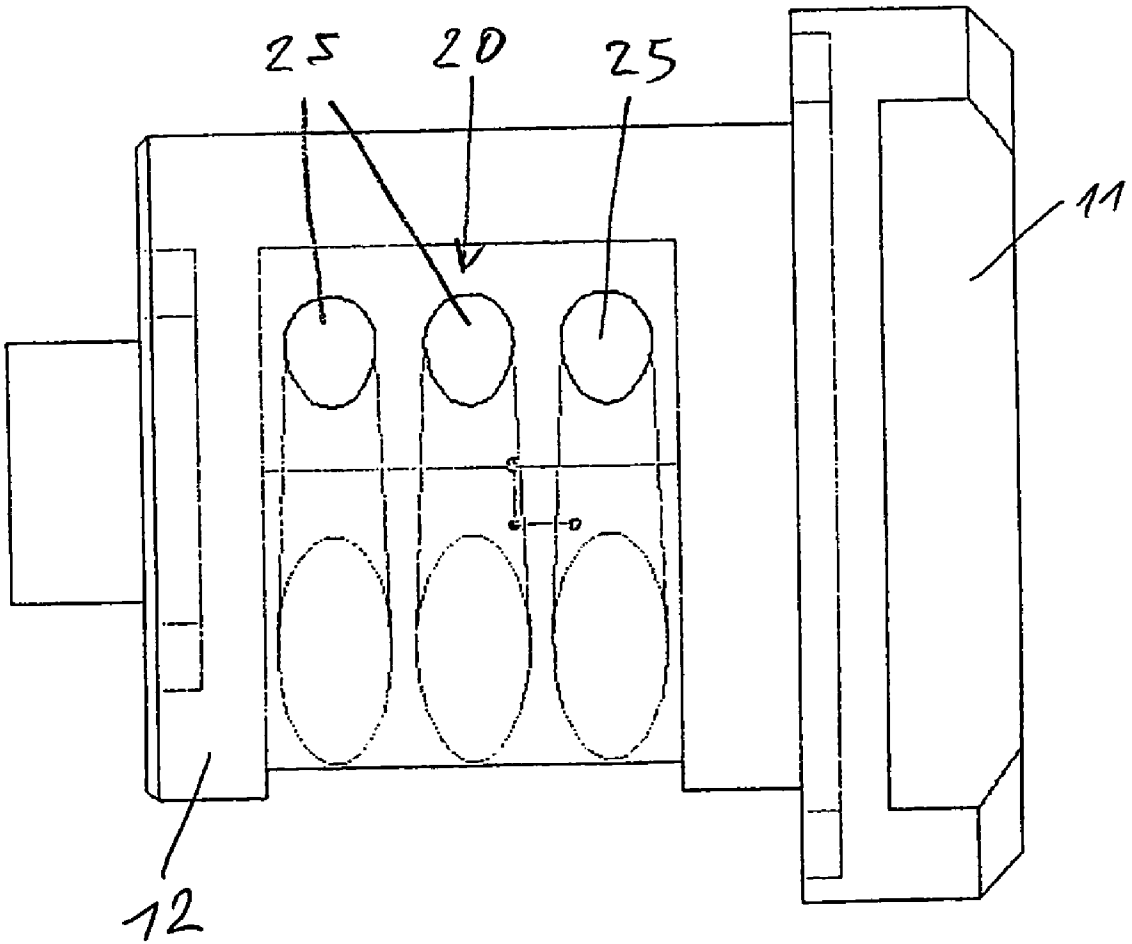

FIG. 5 shows a side view of another embodiment of the rotary element, with the discharge nozzle 20 forming three nozzle passages 25.

Figure 6:
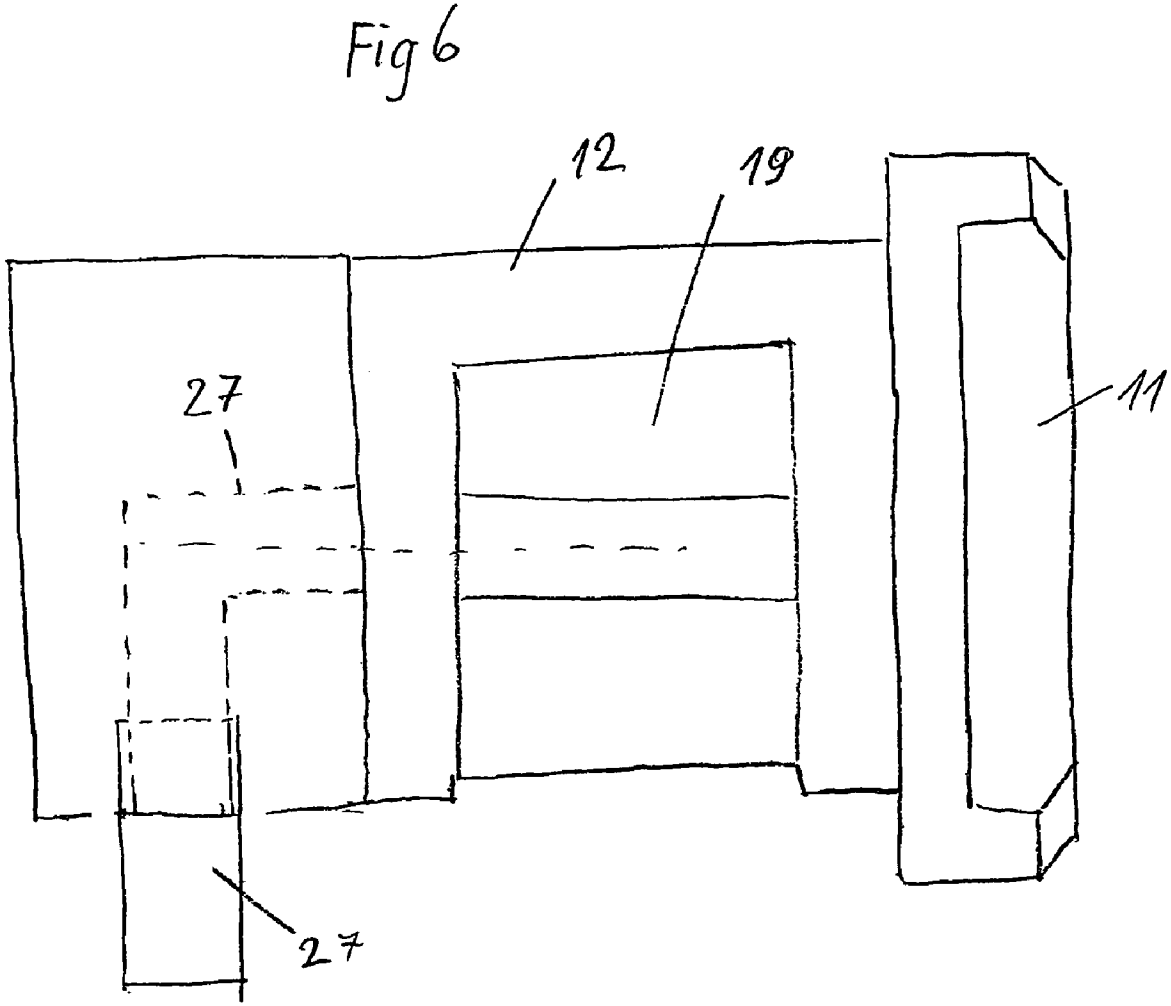
Figure 7:
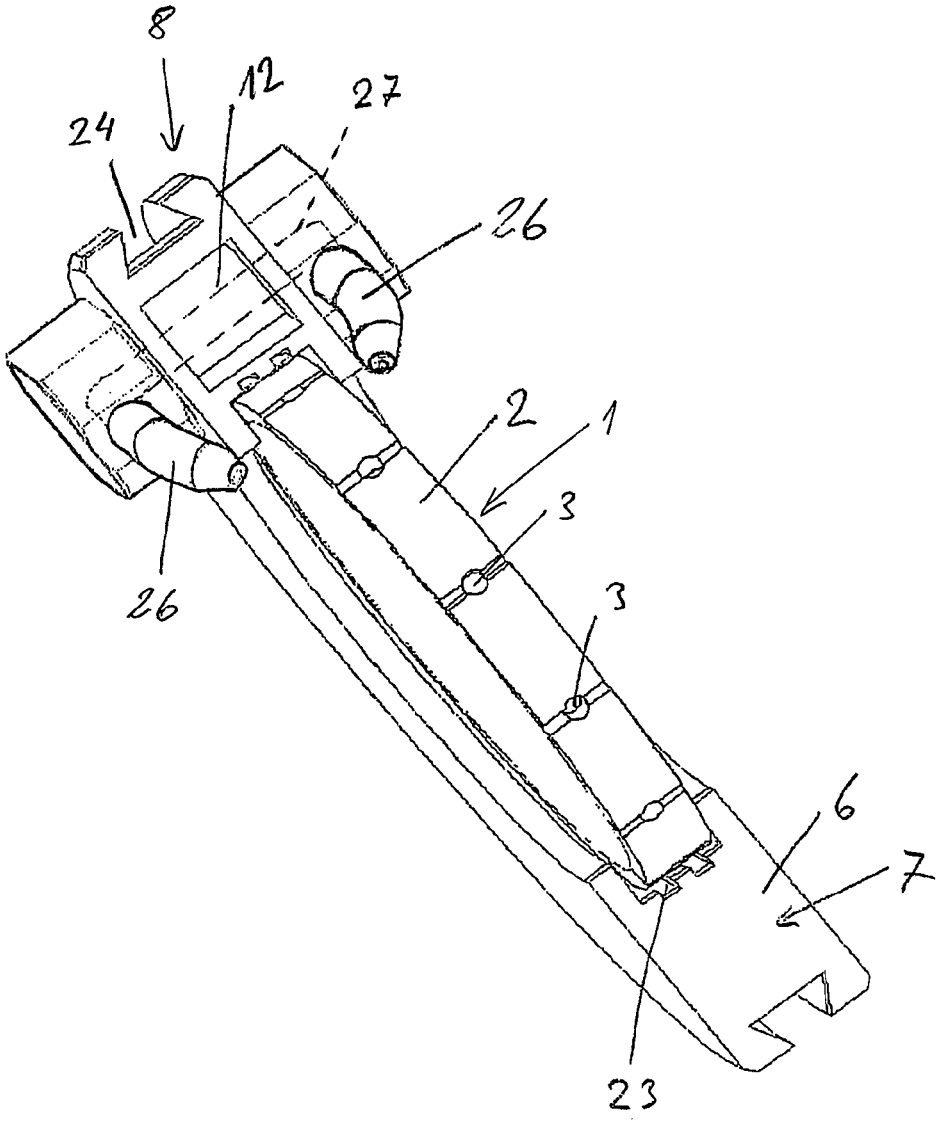
FIG. 7 shows an oblique view of a further embodiment of the invention.

In a further embodiment according to FIG. 6, the rotary element has a branch conduit 27 which diverts the liquid stream, or at least a substream, from the collection chamber 19 and conveys same to a conduit or an external discharge nozzle, not illustrated. It is thus possible to distribute additional targeted coolant streams onto the workpiece or the grinding surface. FIG. 7 shows such a system on a grinding disk where the cooling liquid is streamed on both sides from the rotary element 12 into two external discharge nozzles 26, thus allowing the cooling liquid to be supplied from another angular position.

With regard to the collecting groove as illustrated in FIG. 3, for example, the cross-sectional shape thereof may be chosen at the discretion of one skilled in the art. The cross-sectional shape of the collecting groove may be adapted to the cross section of the grinding disk, for example, in particular when profiled parts are ground.

The apparatus according to the invention offers not only the advantage of improved supply of coolant to the grinding location, but also makes separate rinsing of the grinding surface of the grinding disk unnecessary.

The grinding-disk shield is illustrated in the figures as a cast element, but may also be made of plastic or metal. Production from sheet steel is also possible. The term "cooling liquid" as used herein encompasses all liquids, including lubricants, for example, that are supplied to the grinding surface and/or the workpiece in grinding-disk systems.

The invention claimed is:

1. In combination with a grinding disk rotatable about an axis 10 to grind a workpiece and having an outer periphery through which cooling liquid is projected radially on rotation of the disk, a shield assembly comprising:

a shield juxtaposed with a sector of the grinding disk and formed with a collecting groove closely surrounding a portion of the outer periphery of the disk and forming therewith a passage extending angularly in a rotation direction of the disk from an intake end to an output end, the groove being so closely spaced from the disk that, on rotation of the disk, liquid exiting radially from the outer periphery is propelled angularly as a stream along the groove toward the output end thereof; and nozzle means in the shield at the output end for intercepting at least a portion of the stream and directing it as a substream through a nozzle passage at a location generally where the periphery of the disk engages the workpiece.

2. The grinding-disk shield according to claim 1 wherein the collecting groove has a widening by means of which the cooling liquid is conducted to the nozzle means.

3. The grinding-disk shield according to claim 2 wherein the nozzle means is a rotary element rotatably supported in the shield, thereby allowing a substream direction to be adjusted.

4. The grinding-disk shield according to claim 3 wherein the rotary element has a collection chamber open toward the widening of the collecting groove and by means of which the nozzle means is supplied with the cooling liquid.

5. The grinding-disk shield according to claim 3 wherein on the output end the collecting groove runs past the rotary element to an exit slot so that another substream of the cooling liquid is entrained along the grinding surface, and the other substream is discharged through the exit slot.

6. A grinding-disk shield for internally cooled grinding disks where cooling liquid is outwardly discharged through openings in a peripheral grinding surface, the shield having for the cooling liquid a collecting groove that surrounds the grinding disk over a sector and that has at least one discharge nozzle on an output side by means of which a jet may be directed onto the workpiece to be ground or onto a grinding location, the groove being widened at the nozzle and output side, the nozzle being rotatable in the shield for adjustment of the jet and having a turning handle.

7. The grinding-disk shield according to claim 3 wherein the nozzle means has multiple nozzle passages.

8. A grinding-disk shield for internally cooled grinding disks where cooling liquid is outwardly discharged through openings in a peripheral grinding surface, the shield having for the cooling liquid a collecting groove that surrounds the grinding disk over a sector and that has at least one discharge nozzle on an output side by means of which a jet may be directed onto the workpiece to be ground or onto a grinding location, the groove being widened at the nozzle and output side, the nozzle being rotatable in the shield for adjustment of the jet and having at least one branch conduit for conducting another substream of the cooling liquid to a conduit or an external discharge nozzle.

9. The grinding-disk shield according to claim 2 wherein the widening extends in a continuous progression from the collecting groove.

* * * * *